US007036564B2

(12) United States Patent
Soh

(10) Patent No.: US 7,036,564 B2
(45) Date of Patent: May 2, 2006

(54) CLEANING SYSTEM

(75) Inventor: Beng Kiat Peter Soh, Rochor Centre (SG)

(73) Assignee: Hydroball Technics Holdings PTE Ltd., Singapore (SG)

( * ) Notice: Subject to any disclaimer, the term of this patent is extended or adjusted under 35 U.S.C. 154(b) by 0 days.

(21) Appl. No.: 10/505,249

(22) PCT Filed: Mar. 28, 2003

(86) PCT No.: PCT/SG03/00065

§ 371 (c)(1),
(2), (4) Date: Aug. 20, 2004

(87) PCT Pub. No.: WO03/102487

PCT Pub. Date: Dec. 11, 2003

(65) Prior Publication Data

US 2005/0067136 A1 Mar. 31, 2005

(30) Foreign Application Priority Data

May 30, 2002 (SG) ..... 200203246
Sep. 9, 2002 (SG) ..... 200205422

(51) Int. Cl.
*F28G 1/00* (2006.01)

(52) U.S. Cl. ..... 165/95; 15/3.51; 15/104.05; 15/104.11; 165/303

(58) Field of Classification Search ..... 165/95; 15/3.5, 3.51, 104.03–104.16
See application file for complete search history.

(56) References Cited

U.S. PATENT DOCUMENTS 3,215,195 A 11/1965 Treplin
3,978,917 A * 9/1976 Honma et al. ..... 165/95
4,420,038 A * 12/1983 Okouchi et al. ..... 165/95
4,556,102 A * 12/1985 Bochinski et al. ..... 165/95
4,569,097 A * 2/1986 Echols ..... 15/104.061
4,865,121 A * 9/1989 Ben-Dosa ..... 165/95
5,388,636 A * 2/1995 Peery ..... 165/95
5,518,068 A * 5/1996 Ricard ..... 165/95
5,592,990 A 1/1997 Ben-Dosa

FOREIGN PATENT DOCUMENTS

| | | |
|---|---|---|
| DE | 1 247 359 | 8/1967 |
| EP | 0 200 820 A | 11/1986 |
| FR | 2479439 | 10/1981 |
| FR | 2522993 | 9/1983 |
| GB | 700833 | 12/1953 |

* cited by examiner

*Primary Examiner*—Terrell Mckinnon
(74) *Attorney, Agent, or Firm*—Hoffmann & Baron, LLP

(57) ABSTRACT

A cleaning system for cleaning tubing using cleaning balls (20) circulated with the fluid through tubing (8). The system includes a separator (12) having a perforated funnel, which permits the fluid, but not the cleaning balls (20), to pass through. A housing (21) having an apertured partition (28) is used to divide the housing (21) into an first compartment (19) and a second compartment (27). An entrance (2) of a fluid supply pipe (23) and an exit (3) of a ball supply pipe (24) are formed for creating a difference in pressure to create a suction force to recirculate the cleaning balls (20) from the housing (21) via the ball supply pipe (24), back to the tubing (8) for cleaning the walls of the tubing (8). An entrance (13) of a ball return pipe (17) and an exit (14) of a fluid return pipe (16) are formed for creating a difference in pressure to create a suction force to recirculate the cleaning balls (20) from the separator (12) via the ball return pipe (17), into the housing (21).

13 Claims, 6 Drawing Sheets

CLEANING SYSTEM

CROSS-REFERENCE TO RELATED APPLICATIONS

This application is the National Stage of International Application No. PCT/SG03/00065, filed Mar. 28, 2003, which claims the benefit of Singapore Application Nos. SG 200203246-4, filed May 30, 2002, and SG 200205422-9, filed Sep. 9, 2002, the contents of which are incorporated by reference herein.

FIELD OF THE INVENTION

This invention relates to a cleaning system which uses mobile cleaning elements for cleaning the inside of tubing.

BACKGROUND OF THE INVENTION

A heat distributing system typically has a condenser unit which includes tubing to conduct fluids. There have been proposed different ways of cleaning the inside of such tubing to prevent the build up of dirt or other unwanted deposits Inside the tubing as the fluids travel through the tubing.

One proposed way is the use of cleaning balls made of rubber or spongy material which have a diameter slightly larger than the tubing so that when they travel through the tubing with the fluid, the balls are compressed. In this way, the balls are made to rub against the walls of the tubing so as to keep the walls clean and substantially free from deposits. Generally, the balls and the fluid are passed through the tubing, in the direction of the fluid flow, from the upstream side to the downstream side of the tubing. The balls are then separated from the fluid at the downstream side and then recirculated back to the upstream side of the tubing. A pump, such as that described in patent document U.S. Pat. No. 6,070,652, typically provides the means to recirculate the balls. However, a disadvantage of using a pump to recirculate the balls is that the pump is susceptible to malfunctioning and such a system usually requires considerable downtime for maintenance and repair.

To overcome the above disadvantage, there has been proposed a cleaning system that does not use a pump to recirculate the balls, an example of which is described in patent document U.S. Pat. No. 5,592,990. In this prior art, the recirculating means comprises a housing disposed between the upstream and downstream side of the tubing. The housing includes an apertured partition which divides the housing into a upper compartment and a lower compartment. When the balls are recirculated and collected by this housing, the partition permits the fluid to pass through to the lower compartment while keeping the balls in the upper compartment. The housing further comprises a first passageway which connects one end of the upper compartment to the downstream side of the tubing, a second and third passageway connecting the other end of the upper compartment to a first and second section in the upstream side of the tubing such that the second section of the tubing has a slightly lower pressure compared to the pressure at the first section but higher than that at the downstream side of the tubing. The housing also comprises a fourth passageway connecting the lower compartment to a source of lower pressure than that in any of three other passageways. The cleaning system disclosed in this prior art also has a plurality of valves arranged to control the fluid flow along the different passageways described above. A disadvantage of this prior art is the complexity of the design which requires a sequence of actions to close and open the plurality of valves to recirculate the balls. In addition, to draw the balls into the housing, the valve disposed at the fourth passageway must be opened and this may discharge the fluid. As a result, the fluid is wasted each time the balls are recirculated and the cost of maintaining such a system may be relatively expensive.

It is an object of this invention to provide a cleaning system which alleviates at least one of the disadvantages of the prior art.

SUMMARY OF THE INVENTION

The invention, in general terms, is to provide a system for cleaning tubing connected to an inlet pipe and an outlet pipe, using cleaning elements, such as cleaning balls, which are recirculated by controlling the opening and closing of two valves.

A first object of the invention is a system for cleaning tubing used for conducting a fluid therethrough, the tubing being connected to an inlet pipe and an outlet pipe, the system having

- a plurality of cleaning balls for circulating with the fluid through the tubing;
- a separator disposed at the outlet pipe and arranged to separate the cleaning balls from the fluid;
- a recirculating means comprising
  - a housing arranged to collect the cleaning balls, the housing having a first and second compartment separated by an apertured partition, the apertured partition arranged to allow the fluid to pass through to the second compartment but not the cleaning balls;
  - a ball supply pipe having an entrance coupled to a first opening on the first compartment of the housing and an exit coupled to a first opening on the inlet pipe;
  - a fluid supply pipe having an entrance coupled to a second opening on the inlet pipe and an exit coupled to a second opening on the first compartment of the housing;
  - a fluid return pipe having an entrance coupled to an opening on the second compartment of the housing and an exit coupled to an opening on the outlet pipe;
  - a ball return pipe having an entrance coupled to an opening on the separator and an exit coupled to a third opening on the first compartment of the housing;
- a means for supply of cleaning balls to the inlet pipe whereby a high pressure is formed at the entrance of the fluid supply pipe and a low pressure is formed at the exit of the ball supply pipe, the difference in pressure causing a transfer of cleaning balls from the housing to the inlet pipe; and
- a means for a return of cleaning balls to the housing whereby a high pressure is formed at the entrance of the ball return pipe and a low pressure is formed at the exit of the fluid return pipe, the difference in pressure causing a transfer of cleaning balls from the separator back to the housing wherein the recirculating means, means for supply of cleaning elements and means for return of cleaning balls are arranged to selectively transfer the plurality of cleaning balls from the inlet pipe to the outlet pipe.

Preferably the recirculating means in the cleaning system further comprises a first valve disposed along the fluid supply pipe, a second valve disposed along the fluid return pipe, a first one-way valve disposed along the ball supply pipe, and a second one-way valve disposed along the ball return pipe; the first one-way valve being operative to transfer the cleaning elements from the housing to the inlet pipe and the second one-way valve being operative to transfer the cleaning balls from the separator to the housing.

Preferably the recirculating means in the cleaning system further comprises a third valve disposed along the ball return pipe and a fourth valve disposed along the ball supply pipe.

Preferably the means for supply of cleaning balls in a cleaning system is operative by opening of the first valve and keeping the second valve closed creating a high pressure at the entrance of the fluid supply pipe and a low pressure at the exit of the ball supply pipe, the high pressure creating a suction force to draw the fluid from the inlet pipe into the housing through the fluid supply pipe, the force of the fluid flowing through the housing carrying the cleaning balls from the housing through the first one way valve, into the ball supply pipe in which the fourth valve remains opened, causing the cleaning balls to flow into the inlet duct.

Preferably the means for return of cleaning balls in a cleaning system is by operative by opening of the second valve and keeping the first valve closed creating a high pressure at the entrance of the ball return pipe and a low pressure at the exit of the fluid return pipe, the high pressure creating a suction force to draw the fluid and the cleaning balls from the separator through the second one way valve and into the ball return pipe, the force of the fluid carrying the cleaning balls through the second one-way valve, into the ball return pipe into the housing, wherein said cleaning balls are retained in the housing while the fluid flows through the apertured partition in the housing to return to the fluid return pipe in which the second valve remains opened, and into the outlet duct.

Preferably the cleaning system has a separator in a shape of a funnel.

Preferably the separator in the cleaning system comprises perforations which allow the fluid to flow through but not the cleaning balls.

Preferably the perforations of the separator are in the form of rectangular slots each having a length direction.

Preferably the length directions of the rectangular slots of the separator are not parallel to the centre axis of the funnel.

Preferably the cleaning system has a first means to rotate the fluid and the cleaning balls at the inlet pipe before the tubing so that the cleaning balls enter the tubing randomly distributed.

Preferably the cleaning system has a second means to rotate the fluid and the cleaning balls is at the outlet pipe before the separator so that the dirt accumulated on the surface of the cleaning balls in its passage through the tubing is loosened from the surface of the cleaning balls and carried away in the fluid.

Preferably the direction of the means to rotate the fluid and cleaning balls is opposite to the length direction of the rectangular slots.

An advantage of the described embodiment of the invention is that the different pressures at the inlet pipe and the outlet pipe create suction force which provides an easy and cost efficient way of circulating the cleaning balls for cleaning the tubing. Such a system is also environmental friendly since there is no wastage of the fluid.

The invention is particularly useful for cleaning the fluid-conducting tubing of a heat-exchanger or a condenser, and the invention is therefore described below with respect to such an application.

BRIEF DESCRIPTION OF THE DRAWINGS

An embodiment of the invention will now be described, by way of example, with reference to the accompanying drawings, in which.

DETAILED DESCRIPTION OF THE PREFERRED EMBODIMENT

Figure 1:
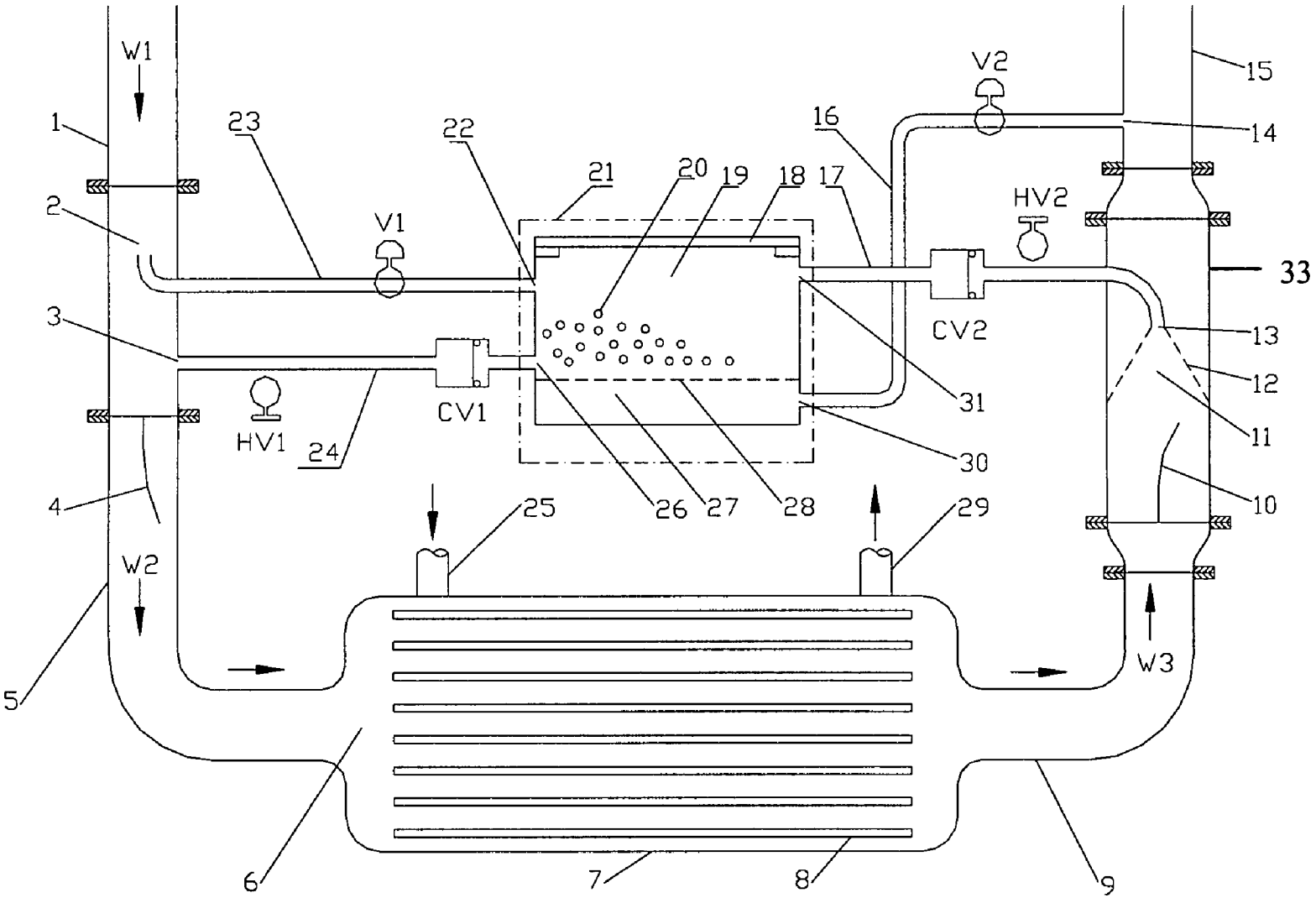
FIG. 1 illustrates a cleaning system according to the invention which comprises a housing to collect the cleaning balls at rest and a separator.

FIG. 1 illustrates a cleaning system used to clean tubing 8 in a condenser 7. The tubing 8 is in the form of a plurality of parallel spaced tubes which are connected to an inlet pipe 5 and an outlet pipe 9. A cooling fluid such as water is passed through the tubing 8 in order to condense another fluid, such as steam or a refrigerant gas, from an inlet 25 which circulates through the spaces between the tubing 8 and to an outlet 29.

The cooling fluid (in a direction as indicated by W1) is circulated through the condenser tubing 8 from an inlet duct 1, which is connected to the upstream side of the condenser tubing 8 by the inlet pipe 5, to an outlet duct 15 connected to the downstream side of the tubing 8 by the outlet pipe 9.

The cleaning system comprises a plurality of cleaning elements and in this embodiment cleaning balls 20 are used. Such cleaning balls 20 are typically made from spongy material and have a diameter slightly larger than the diameter of the tubing 8 so that the balls 20 are compressed when they are forced through the tubing 8 to prevent the lodging or settling of particles within the tubing 8. In this way, unwanted deposits are prevented from building up in the tubing 8 which may lower the efficiency of the heat exchange, or even cause corrosion.

The cleaning system further comprises a separator 12 and recirculating means to transfer the cleaning balls 20 from the outlet pipe 9 to the inlet pipe 5.

The function of the separator 12 is to separate the cleaning balls 20 from the cooling fluid at the outlet pipe 9 and in this embodiment, the separator 12 has a shape of a funnel. The separator 12 is interposed within an enlarged section of the outlet pipe 33 between the outlet pipe 9 and the outlet duct 15 which releases the fluid. The separator 12 comprises perforations arranged to allow the fluid to pass through to the outlet duct 15 but not the cleaning balls 20.

Figure 5:
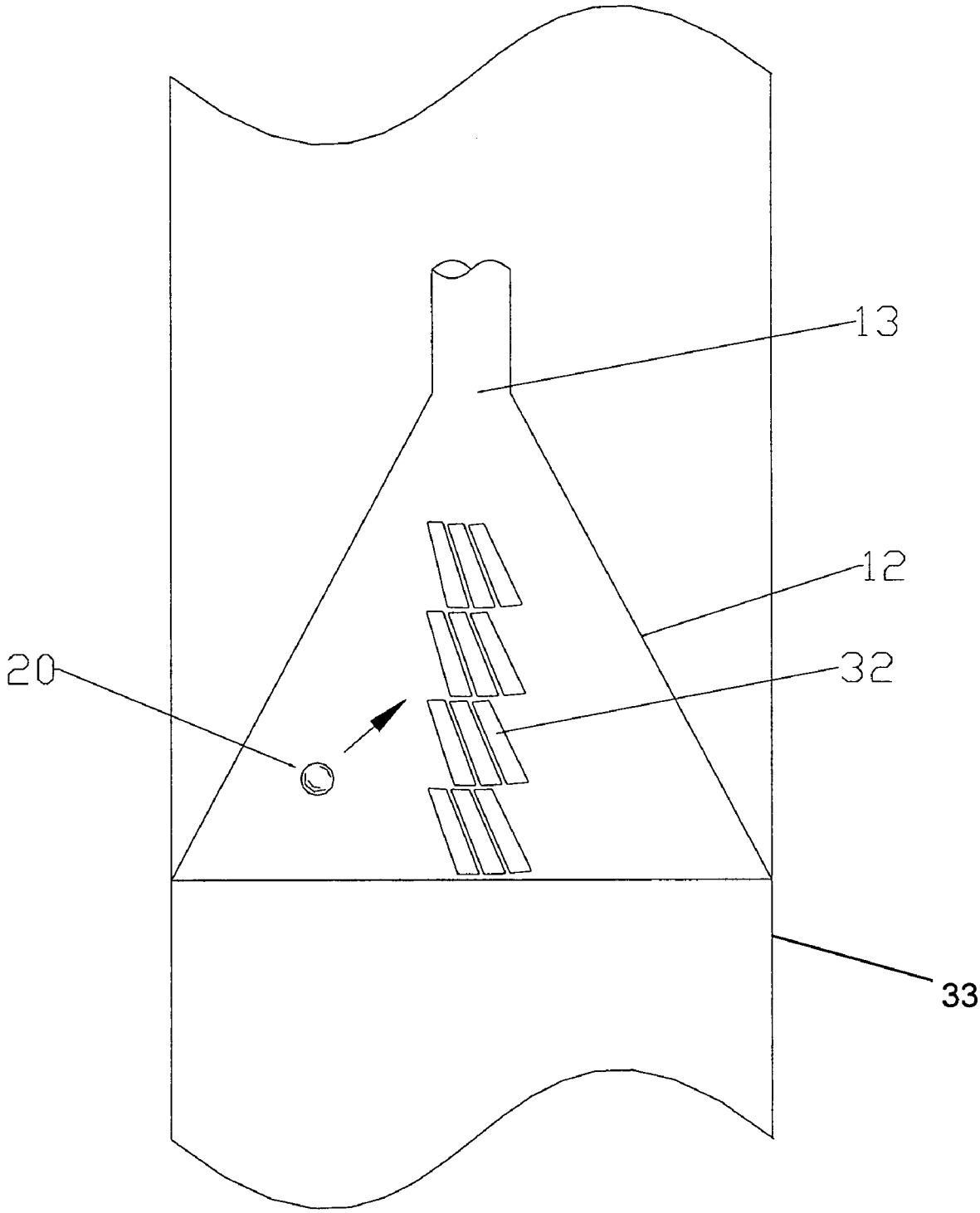
FIG. 5 illustrates a cross-sectional view of the separator of FIG. 3 which traps the cleaning balls after they have passed through the tubing.
Figure 6:
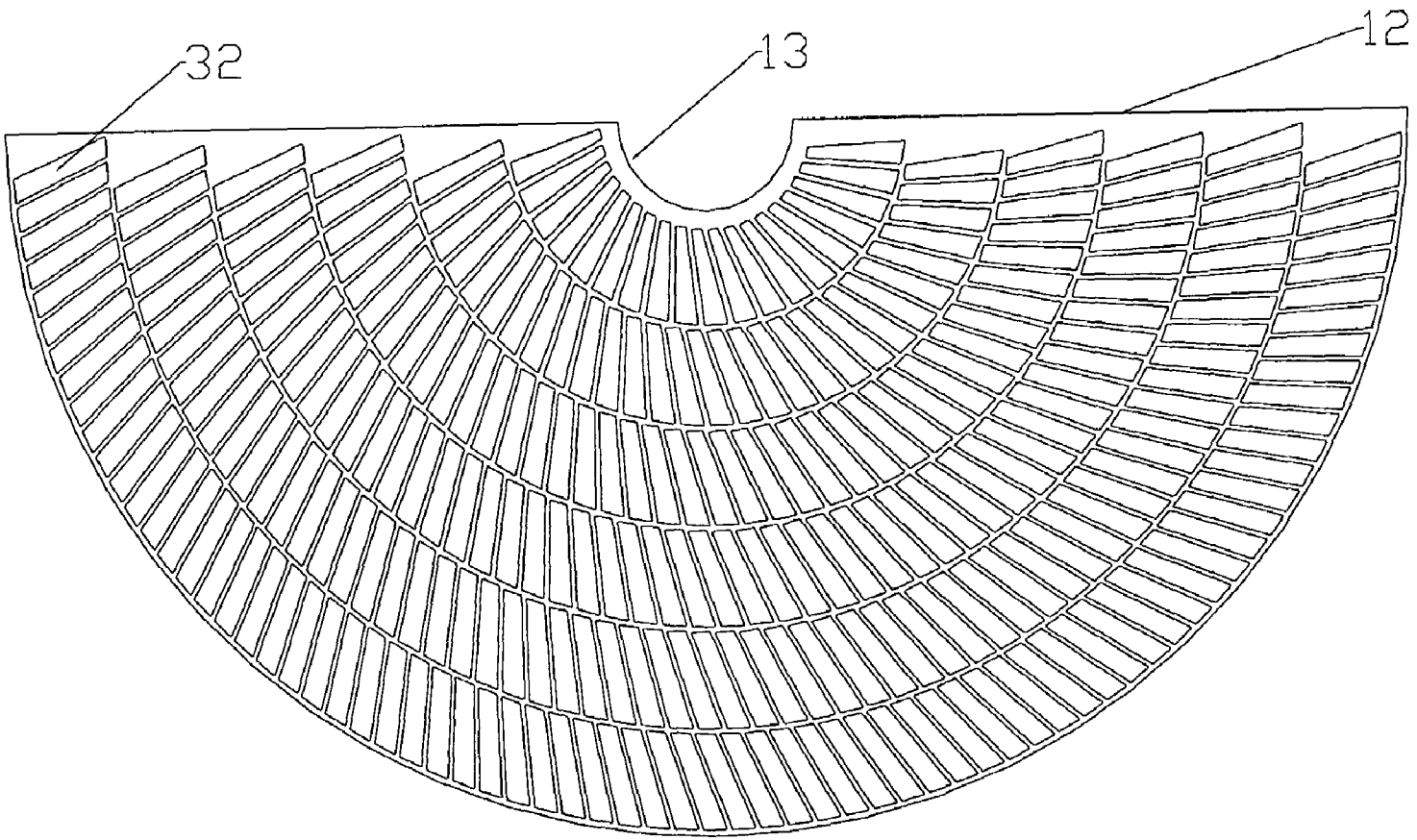
FIG. 6 shows a detailed view of the separator of FIG. 5.

Preferably, the perforations are in the form of rectangular slots 32 having a length direction inclined in a particular direction, for example anti-clockwise, as viewed in the fluid flow direction. Detailed views of the separator 12 according to this embodiment and the rectangular slots 32 are shown in FIGS. 5 and 6, respectively. The separator 12 is connected to the recirculating means for transferring the cleaning balls 20 from the outlet pipe 9 to the inlet pipe 5.

In this embodiment, the recirculating means comprises a housing 21 for collecting the cleaning balls 20. The housing 21 has an apertured partition 28 dividing the interior of the housing 21 into an first compartment 19 and a second compartment 27 on opposite sides of the partition 28. The partition 28 permits the fluid, but not the cleaning balls 20, to pass through so that the cleaning balls 20 accumulate within the first compartment 19. The housing 21 may further include a cover 18 for covering the first compartment 19 and which is removable therefrom in order to add or remove the cleaning balls 20.

The recirculating means further comprises a fluid return pipe 16 and a ball return pipe 17. The fluid return pipe 16 is used to connect the housing 21 to the outlet duct 15 for transferring the fluid (not the cleaning balls 20) from the housing 21 to the outlet duct 15. The fluid return pipe 16 has an entrance 30 on the second compartment 27 of the housing 21 and an exit 14 on the outlet duct 15. The ball return pipe 17 is used to connect the separator 12 to the housing 21 for transferring the cleaning balls 20 from the outlet pipe 9 to the housing 21. The ball return pipe 17 has an entrance 13 on the separator 12 and an exit 31 on the first compartment 19 of the housing 21. The entrance open mouth 13 of the ball return pipe 17 is formed in the direction against the fluid flow W3 of the outlet pipe 9 such that the pressure at the entrance 13 of the ball return pipe 17 is higher than that at the exit 14 of the fluid return pipe 16. The ball return pipe 17 may include a hand valve HV2 which is always open except when replacing or adding the cleaning balls 20.

The recirculating means also comprises a ball supply pipe 24 and a fluid supply pipe 23. The ball supply pipe 24 is used to connect the housing 21 to the inlet pipe 5 for supplying the cleaning balls 20 back to the inlet pipe 5 from the housing 21.

The ball supply pipe 24 has an entrance 26 on the first compartment 19 of the housing 21 and an exit 3 on the inlet pipe 5. The ball supply pipe 24 may include a hand valve HV1 which is always open except when changing the cleaning balls 20. The fluid supply pipe 23 is used to connect the inlet pipe 5 to the housing 21 for supplying the fluid from the inlet pipe 5 to the housing 21. The fluid supply pipe 23 has an entrance 2 on the inlet pipe 5 and an exit 22 on the first compartment 19 of the housing 21. The entrance 2 of the fluid supply pipe 23 is formed in the direction against the fluid flow W1 of the inlet pipe 5 such that the pressure at the entrance 2 of the fluid supply pipe 23 is higher than that at the exit 3 of the ball supply pipe 24.

The means for supply of cleaning balls and means for return of cleaning balls comprises two valves V1 and V2 disposed along the fluid supply pipe 23 and the fluid return pipe 16 to control the flow of the cleaning balls 20 from the downstream side of the condenser tubing 8 to the upstream side of the condenser tubing 8 via the housing 21. The means to supply cleaning balls 20 is operative by the opening of the first valve V1 and keeping the second valve V2 closed so that the cleaning balls 20 are sucked from the housing 21 to the inlet pipe 5. The means to return cleaning balls 20 is operative by the opening of the second valve V2 and keeping the first valve V1 closed, so that the cleaning balls 20 are sucked from the separator 12 back to the housing 21.

The housing 21 also comprises two check valves or one-way valves, CV1 and CV2 disposed along the ball supply pipe 24 and the ball return pipe 17. The first check valve CV1 only permits the fluid and the cleaning balls 20 flow in the direction from the housing 21 to the inlet pipe 5, and not vice versa. The second check valve CV2 only permits the fluid and the cleaning balls 20 flow in the direction from the separator 12 to the housing 21, and not vice versa.

The cleaning system may further comprise rotation means arranged at the inlet pipe 5 and outlet pipe 9 and in this embodiment propellers are used.

A first propeller 4 is placed at the inlet pipe 5 and before the tubing 8 to rotate the cleaning balls 20 so that the cleaning balls 20 enter the tubing 8 in a random pattern, as indicated by reference numeral 6. The rotation means are to ensure the cleaning balls 20 are randomly distributed by centrifugal force as they enter the condenser 7. A second propeller 10 is placed at the outlet pipe 9 and before the separator 12 so that the fluid and the cleaning balls 20 are rotated to let the cleaning balls 20 collide with each other at the mouth 11 of the separator 12. This is to increase the number of collisions amongst the cleaning balls 20 so as to remove the dirt accumulated on the surfaces of the cleaning balls 20 after their passage through the tubing 8.

Having described the various components of the cleaning system, an operation of the cleaning system will now be described with reference to FIGS. 1, 2, 3 and 4.

We assume an initial position, which is illustrated in FIG. 1, whereby the valves V1 and V2 are closed and the cleaning balls 20 are accumulated within the first compartment 19 of the housing 21. There is no flowing of fluid in the ball supply pipe 24 and the ball return pipe 17 because of the pressure at the exit 3 of the ball supply pipe 24 is higher than that at the entrance 13 of the ball return pipe 17 and the function of the two check valves CV1 and CV2.

When the condenser 7 is operating, the cooling fluid Is going through the inlet pipe 5. According to a principle of fluid mechanics, the static pressure at the entrance 2 of the fluid supply pipe 23 would be higher than that at the exit 3 of the ball supply pipe 24 because of the entrance 2 of the fluid supply pipe 23 is formed in the direction against the fluid flow W1 of the inlet pipe 5. This difference in pressure creates a suction force to draw or suck the fluid from the inlet pipe 5 into the housing 21 via the fluid supply pipe 23 and to draw or suck the fluid and the cleaning balls 20 from the housing 21 into the inlet pipe 5 via the ball return pipe 24.

Figure 2:
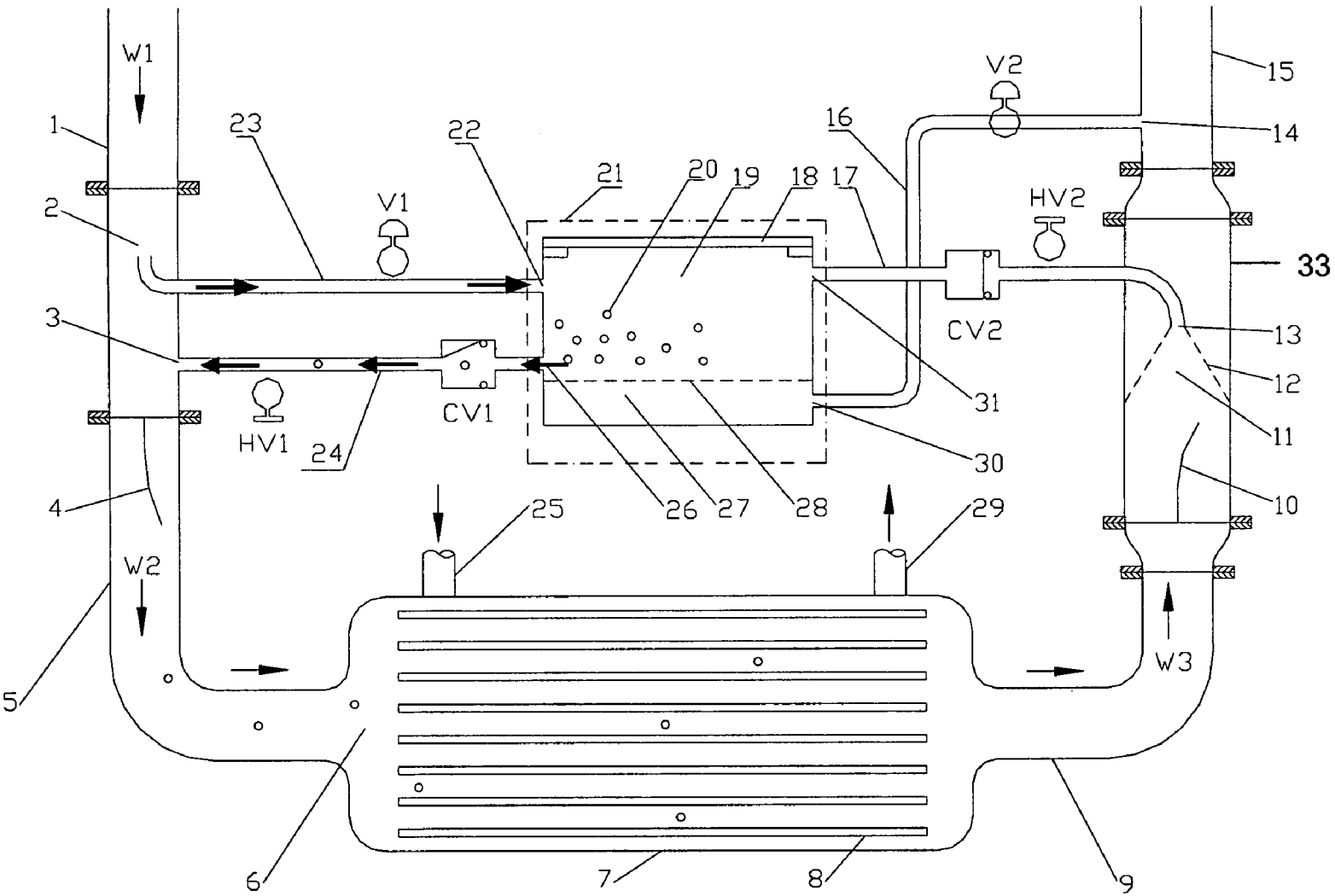
FIG. 2 illustrates the cleaning system of FIG. 1 when the cleaning balls are caused to circulate through the tubing commencing from the housing.

To allow the cleaning balls 20 to be drawn out from the housing 21 to the inlet pipe 5, the first valve V1 is opened with the second valve V2 is closed, so that the fluid drawn from the inlet pipe 5 to the housing 21 and the cleaning balls 20 are then sucked out from the housing 21 and into the inlet pipe 5 for circulating to the tubing 8 to clean the internal walls of the tubing 8. This is the condition illustrated in FIG. 2. The direction of the fluid flow from the fluid supply pipe 23 into the housing 21 and the flow of cleaning balls 20 from the housing 21 through the one way check valve CV1 is shown in FIG. 2 by the bold arrows.

The means for supply of cleaning balls 20 arising from the transfer of cleaning balls 20 is operative by opening the first valve V1 and keeping the second valve V2 closed. In this manner, cleaning balls 20 from the housing 21 are drawn or sucked from the housing 21 to the upstream side of the tubing 8, based on the difference in pressure of the entrance 2 of the fluid supply pipe 23 and the exit 3 of the ball supply pipe 24.

After all the cleaning balls 20 are drawn into the inlet pipe 5, valve V1 is then closed and V2 remained closed. The supply of cleaning balls 20 is stopped when the first valve V1 is closed, as illustrated in FIG. 3.

The first propeller 4, at the time when the first valve V1 is opened, is also activated to force the fluid flow W2 and also the cleaning balls 20 to rotate and as a result the cleaning balls 20 enter the tubing 8 randomly.

After the cleaning process, the second propeller 10 again rotates the cleaning balls 20 so that the cleaning balls 20 collide with each other and the dirt particles, which were removed by the cleaning balls 20 from tubing 8 and are now attached to the cleaning balls 20, are "rubbed" off. The dirt particles would then be carried by the fluid flow W3 for discharge though the outlet duct 15. It should be noted that the direction of rotation of the second propeller 10 and thus the cleaning balls 20 is preferably in the opposite direction when compared to the inclined slots 32 of the separator 12. For example, if the length direction of the Inclined slots 32 is anti-clockwise, then the rotation of the cleaning balls 20 by the propeller 10 should, preferably, be clockwise. This would increase the collision of the cleaning balls 20 with each other.

Figure 3:
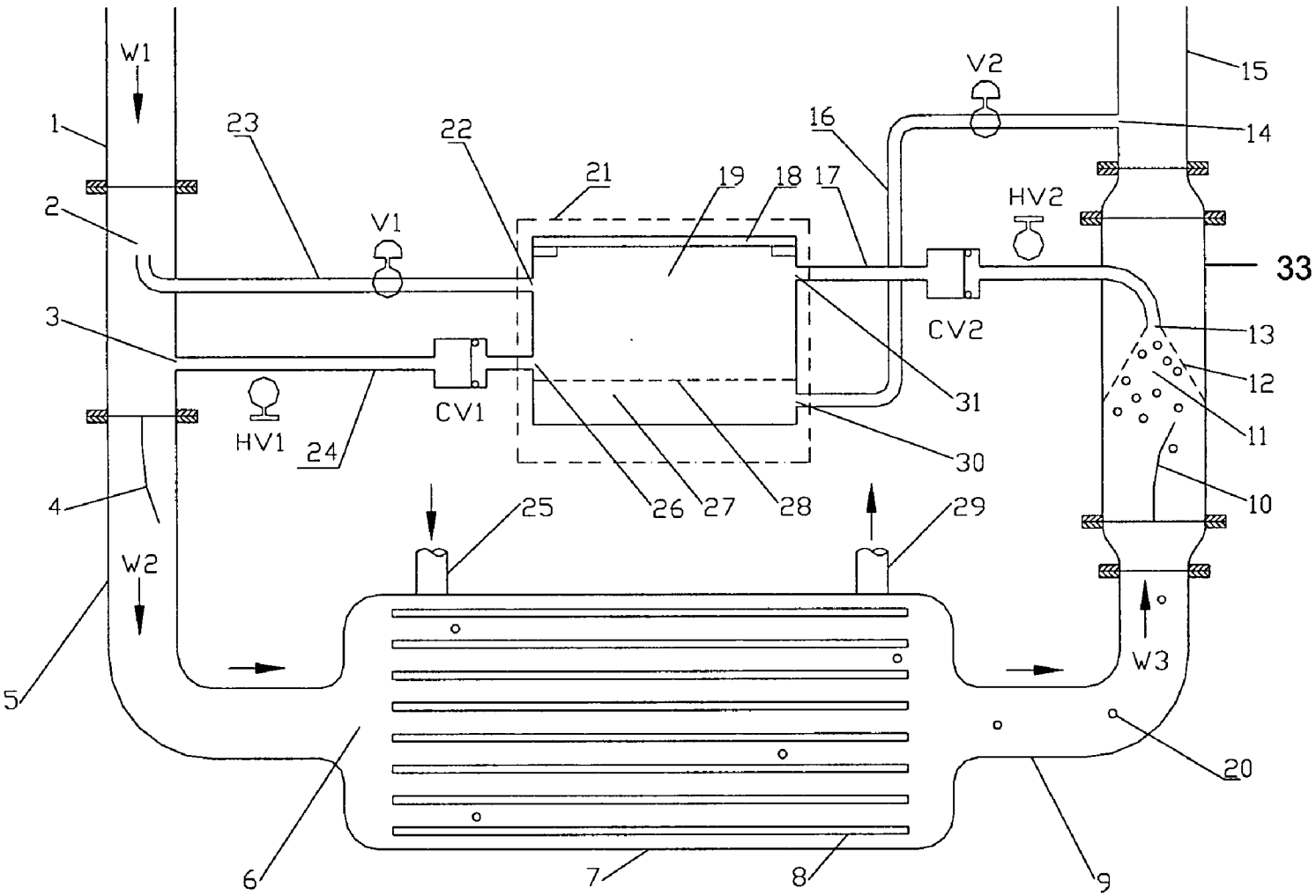
FIG. 3 illustrates the situation when the cleaning balls have passed through the tubing and are trapped by the separator of FIG. 1.
Figure 4:
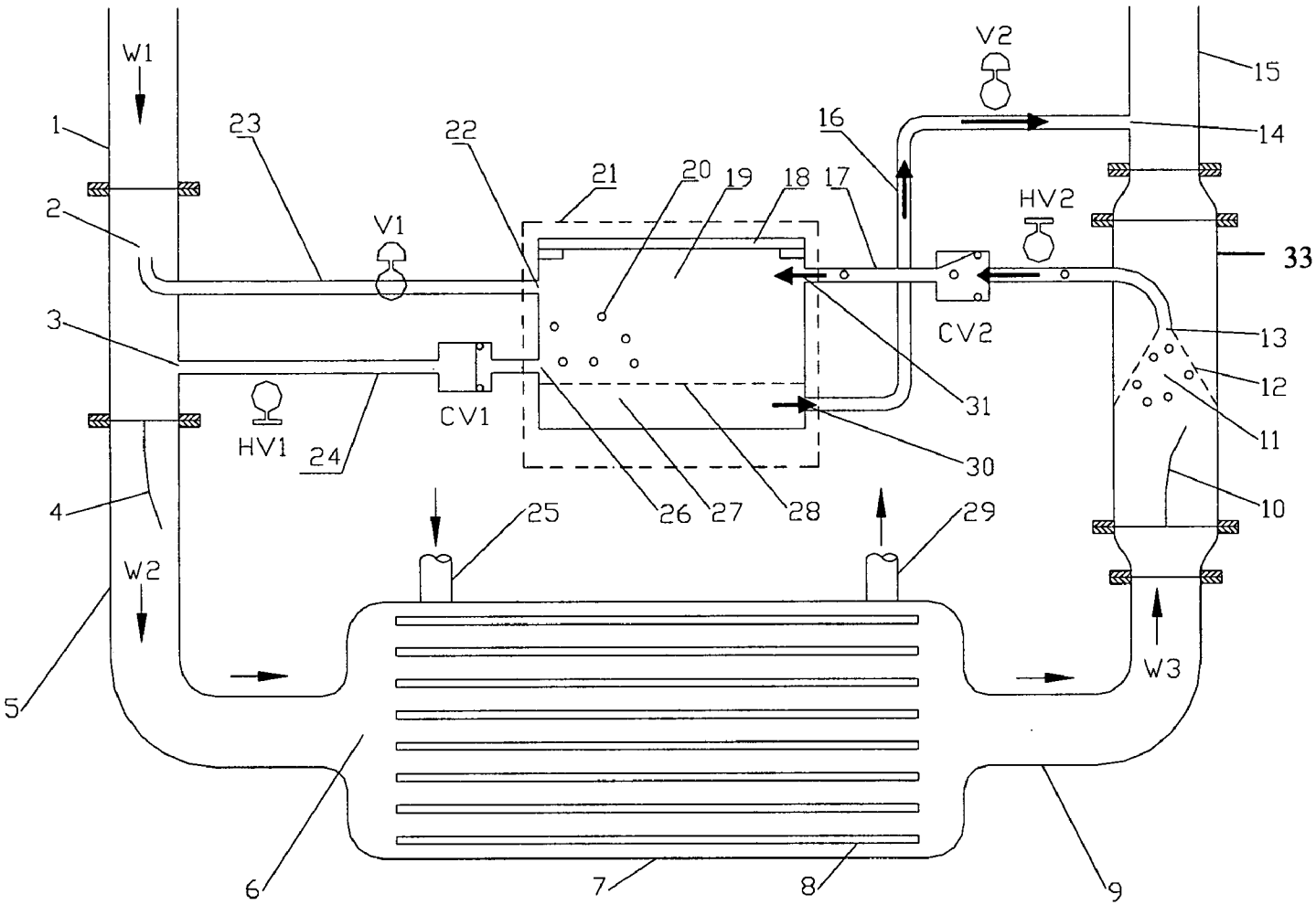
FIG. 4 illustrates the situation when the cleaning balls are caused to circulate back to the housing of FIG. 1.

After the rotation, the cleaning balls 20 accumulate at the mouth 11 of the separator 12, as illustrated in FIG. 3.

According to a principle of fluid mechanics, the static pressure at the entrance 13 of the ball return pipe 17 would be higher than that at the exit 14 of the fluid return pipe 16 because of the entrance 13 of the ball return pipe 17 is formed in the direction against the fluid flow W3 of the outlet pipe 9. This difference in pressure creates a suction force to draw or suck the fluid (and the cleaning balls 20) from the separator 12 and into the housing 21 via the ball return pipe 17 and to draw or suck the fluid (not the cleaning balls 20, because of the apertured partition 28 of the housing 21) from the housing 21 to the outlet duct 15 via the fluid return pipe 16.

The means for return of cleaning balls 20 from the separator 12 back to the housing 21 is operative by the opening of the second valve V2 and keeping the first valve V1 closed, so that the cleaning balls 20 are sucked from the separator 12 to the housing 21 and the fluid (not the cleaning balls 20, because of the apertured partition 28 of the housing 21) drawn from the housing 21 to the outlet duct 15. This is the condition illustrated in FIG. 4. The direction of flow of fluid and cleaning balls 20 from the ball return pipe 17 into the housing 21 and flow of fluid from the first compartment 17 into the second compartment 27 and then into the fluid return pipe 16 is shown by the bold arrows.

Finally, when all the cleaning balls 20 have arrived back at the first compartment 19 of the housing 21 and are accumulated there, both valves V1 and V2 are then closed, as illustrated in FIG. 1. The operation for return of cleaning balls 20 is stopped when the second valve V2 is closed.

It can be seen that the means for return of cleaning balls 20 into the housing 21 is operative by opening the second valve V2 and keeping the first valve V1 closed. The means for supply of cleaning balls 20 from the housing 21 into the cleaning system is operative by opening the first valve V1 and keeping the second valve V2 closed. In both operations, the cleaning balls 20 are circulated through the recirculating means by operation of the means for supply of cleaning balls and operation of the means for return of cleaning balls. In both operations, it is the opening and closing of two valves V1 and V2 and vice versa which creates the differences in pressure between the entrance 13 of the ball return pipe 17 and the exit 14 of the fluid return pipe 16 and differences in pressure between the entrance 2 of the fluid supply pipe 23 and the exit 3 of the ball supply pipe 24. The operation of the whole cleaning system can therefore be easily controlled via the two valves V1 and V2, which can be manually operated or mechanically operated.

When a need arises, when the cleaning balls 20 need to be replaced, the hand valves HV1 and HV2 are closed and the cover 18 is opened, so that the cleaning balls 20 can be replaced.

While the invention has been described with respect to one preferred embodiment, it will be appreciated that this is set forth merely for purposes of example, and that many variations, modifications and applications of the invention may be made therein by one skilled in the art without departing from the scope of the invention as defined in the appended claims.

Advantageous Effects of the Invention

From the described embodiment, it can be observed that the operation of the whole cleaning system can easily be controlled via the two valves V1 and V2, which can be manually operated or means provided to operate them automatically. Furthermore, the whole cleaning system have limited moving parts and is therefore more reliable and requires less maintenance.

In addition, the cleaning system does not waste the cooling fluid which can easily be recirculated together with the cleaning balls 20.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A system for cleaning tubing used for conducting a fluid therethrough, the tubing being connected to an inlet pipe and an outlet pipe, the system having a plurality of cleaning balls for circulating with the fluid through the tubing;

a separator 12 disposed at the outlet pipe 9, the separator 12 being housed within an enlarged section of the outlet pipe 33 and arranged to separate the cleaning balls 20 from the fluid;

a recirculating means comprising:

a housing 21 arranged to collect the cleaning balls 20, the housing 21 having a first compartment 19 and second compartment 27 separated by an apertured partition 28, the apertured partition 28 arranged to allow the fluid to pass through to the second compartment 27 but not the cleaning balls 20;

a ball supply pipe consisting essentially of a ball supply pipe 24 having an entrance 26 coupled to a first opening on the first compartment 19 of the housing 21 and an exit 3 coupled to a first opening on the inlet pipe 5, a first one-way valve CV1 disposed along the ball supply pipe 24 and a fourth valve HV1 disposed along the ball supply pipe 24;

a fluid supply pipe 23 having an entrance 2 coupled to a second opening on the inlet pipe 5 and an exit 22 coupled to a second opening on either the first compartment 19 or the second compartment 27 of the housing 21;

a fluid return pipe 16 having an entrance 30 coupled to an opening on the second compartment 27 of the housing 21 and an exit 14 coupled to an opening on a section of the outlet pipe 15 after the separator 12; and a ball return pipe consisting essentially of a ball return pipe 17 having an entrance 13 coupled to an opening on the separator 12 and an exit 31 coupled to a third opening on the first compartment 19 of the housing 21, a second one-way valve CV2 disposed along the ball return pipe 17 and a third valve HV2 disposed along the ball return pipe 17;

a means for supply of cleaning balls to the inlet pipe 5 whereby a higher pressure is formed at the entrance 2 of the fluid supply pipe 23 and a lower pressure is formed at the exit 3 of the ball supply pipe 24, the difference in pressure causing a transfer of cleaning balls 20 from the housing 21 to the inlet pipe 5; and a means for a return of cleaning balls 20 to the housing 21, whereby a higher pressure is formed at the entrance 13 of the ball return pipe 17 and a lower pressure is formed at the exit 14 of the fluid return pipe 16, the difference in pressure causing a transfer of cleaning balls 20 from the separator 12 back to the housing 21, and wherein the recirculating means, means for supply of cleaning balls and means for return of cleaning balls are arranged to selectively transfer the plurality of cleaning balls 20 from the inlet pipe 5 to the outlet pipe 9.

2. A cleaning system according to claim 1, wherein the recirculating means further comprises a first valve V1 disposed along the fluid supply pipe 23 and a second valve V2 disposed along the fluid return pipe 16, the first one-way valve CV1 being operative to transfer the cleaning balls 20 from the housing 21 to the inlet pipe 5 and the second one-way valve CV2 being operative to transfer the cleaning balls 20 from the separator 12 to the housing 21.

3. A cleaning system according to claim 1, wherein the recirculating means further comprises the third valve HV2 disposed along the ball return pipe 17 and the fourth valve HV1 disposed along the ball supply pipe 24.

4. A cleaning system according to claim 1, wherein the means for supply of clean balls 20 further comprises a first valve V1 and a second valve V2, whereby opening of the first valve V1 and keeping the second valve V2 closed, owing to higher pressure at the entrance 2 of the fluid supply pipe 23 and a lower pressure at the exit 3 of the ball supply pipe 24, allows the pressure difference to create a suction force to draw the fluid from the inlet pipe 5 into the housing 21 through the fluid supply pipe 23, the force of the fluid flowing through the housing 21 carrying the cleaning balls 20 from the housing 21 through the first one way valve CV1, into the ball supply pipe 24, and into the inlet pipe 5.

5. A cleaning system according to claim 1, wherein the means for the return of cleaning ball 20 further comprises a second valve V2 and a first valve V1, whereby opening of the second valve V2 and the keeping of the first valve V1 closed, owing to a higher pressure at the entrance of the ball return pipe 17 and a lower pressure at the exit 14 of the fluid return pipe 16, allows the pressure difference to create a suction force to draw the fluid and the cleaning balls 20 from the separator 12 through the second one way valve CV2 and into the ball return pipe 17, the suction force of the fluid carrying the cleaning balls 20 through the second one-way valve CV2, into the ball return pipe 17 into the housing 21, wherein said cleaning balls 20 are retained in the housing 21 while the fluid flows through the apertured partition 28 in the housing 21 to return to the fluid return pipe 16 and into the outlet pipe 15 which is smaller in diameter than the enlarged section of the outlet pipe 33 containing the separator 12.

6. A cleaning system according to claim 1, wherein the separator 12 is in a shape of a funnel.

7. A cleaning system according to claim 6, wherein the separator 12 comprises perforations which allow the fluid to flow through but not the cleaning balls 20.

8. A cleaning system according to claim 7, wherein the perforations are in the form of rectangular slots 32 each having a length direction.

9. A cleaning system according to claim 8, wherein the length directions of the rectangular slots 32 are not parallel to the centre axis of the funnel.

10. A cleaning system according to claim 1, further comprising a device 4 to rotate the fluid and the cleaning balls 20 at the inlet pipe 5 before the tubing 8.

11. A cleaning system according to claim 1, further comprising a device 10 to rotate the fluid and the cleaning balls 20 at the outlet pipe 9 before the separator 12.

12. A cleaning system according to claim 9, further comprising a device 10 to rotate the fluid and the cleaning balls 20 at the outlet pipe 9 before the separator 12, wherein the direction of the rotational device is opposite to the length direction of the rectangular slots 32.

13. A cleaning system according to claim 9, wherein the rectangular slots 32 have a length direction inclined clockwise/anti-clockwise, as viewed in the fluid flow direction.

* * * * *